US011573032B2

(12) United States Patent
Boros et al.

(10) Patent No.: US 11,573,032 B2
(45) Date of Patent: Feb. 7, 2023

(54) WATER HEATER PILOT OPERATION

(71) Applicant: Rheem Manufacturing Company, Atlanta, GA (US)

(72) Inventors: Jozef Boros, Montgomery, AL (US); Larry D. Kidd, Wetumpka, AL (US); Raheel A. Chaudhry, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 131 days.

(21) Appl. No.: 16/513,485

(22) Filed: Jul. 16, 2019

(65) Prior Publication Data

US 2021/0018222 A1 Jan. 21, 2021

(51) Int. Cl.

| | |
|---|---|
| ***F24H 9/20*** | (2022.01) |
| ***F23N 1/08*** | (2006.01) |
| ***F23N 5/24*** | (2006.01) |
| ***F24H 1/18*** | (2022.01) |

(52) U.S. Cl.

CPC ..... *F24H 9/2035* (2013.01); *F23N 1/085* (2013.01); *F23N 5/245* (2013.01); *F24H 1/186* (2013.01); *F23N 2223/50* (2020.01); *F23N 2227/02* (2020.01); *F23N 2227/30* (2020.01); *F23N 2227/36* (2020.01); *F23N 2229/02* (2020.01); *F23N 2241/04* (2020.01)

(58) Field of Classification Search

CPC .... F24H 9/205; F24H 9/2035; F23N 2227/22; F23N 2227/30; F23N 2227/24

See application file for complete search history.

(56) References Cited

U.S. PATENT DOCUMENTS

| | | | | | |
|---|---|---|---|---|---|
| 2,007,714 | A * | 7/1935 | Gauger | F23N 5/206 | 431/46 |
| 4,568,821 | A * | 2/1986 | Boe | F24D 19/1051 | 219/508 |
| 4,770,161 | A * | 9/1988 | Charron | F23N 1/085 | 122/448.1 |
| 5,092,519 | A * | 3/1992 | Staats | F23N 5/067 | 236/23 |
| 6,059,195 | A * | 5/2000 | Adams | F24H 9/2035 | 236/94 |
| 6,261,087 | B1 * | 7/2001 | Bird | F23N 5/265 | 431/18 |
| 7,387,089 | B2 * | 6/2008 | Peart | F23D 14/26 | 122/14.31 |
| 9,038,575 | B2 * | 5/2015 | Boros | F23D 14/84 | 122/18.1 |
| 9,657,947 | B2 * | 5/2017 | Cook | F23Q 9/14 | |
| 10,119,726 | B2 * | 11/2018 | Smith | F24H 9/2035 | |
| 10,151,482 | B2 * | 12/2018 | Teng | F23N 5/102 | |

(Continued)

*Primary Examiner* — Gregory A Wilson

(74) *Attorney, Agent, or Firm* — Eversheds Sutherland (US) LLP

(57) ABSTRACT

A method of controlling water heater pilot flame ignition includes receiving, by a controller of a water heater, a user input and controlling a pilot gas valve to start a gas flow to a pilot burner in response to the user input. The method further includes, in response to the user input, controlling, by the controller, an igniter to generate an ignition spark for lighting a pilot flame. The method also includes controlling, by the controller, the pilot gas valve to maintain the gas flow to the pilot burner if the pilot flame is lit.

18 Claims, 5 Drawing Sheets

(56) References Cited

U.S. PATENT DOCUMENTS

| | | | | |
|---|---|---|---|---|
| 10,488,044 | B2 * | 11/2019 | Prichard | F24C 3/10 |
| 10,670,302 | B2 * | 6/2020 | Hazzard | F24H 1/186 |
| 2009/0142720 | A1 * | 6/2009 | Pussell | F24H 1/205<br>122/19.2 |
| 2015/0276265 | A1 * | 10/2015 | Davari | G05B 19/402<br>700/300 |
| 2015/0277463 | A1 * | 10/2015 | Hazzard | F24D 19/1063<br>700/295 |
| 2018/0363949 | A1 * | 12/2018 | Bailey | F24H 9/2035 |
| 2019/0338987 | A1 * | 11/2019 | Young | F24H 1/205 |
| 2021/0048226 | A1 * | 2/2021 | Hazzard | F23N 5/102 |

* cited by examiner

WATER HEATER PILOT OPERATION

TECHNICAL FIELD

The present disclosure relates generally to water heaters, and more particularly to an ignition control of a water heater pilot flame.

BACKGROUND

In a typical atmospherically vented gas-fired water heater, a standing pilot flame may be used to ignite the main burner of the water heater. Atmospherically vented gas-fired water heaters generally rely on a mechanical piezo push button to generate a spark to ignite the pilot flame. A consumer typically has to press the piezo push button multiple times until the pilot flame is lit. The consumer may also need to control the flow of gas to the pilot burner while pressing the piezo push button. The consumer may also need to know where to look to check whether the pilot flame is lit. For example, the user may first need to remove a cover to make the pilot flame viewable in order to check whether the pilot flame is lit. Thus, a solution that simplifies the ignition and reignition of a pilot flame while providing a continuous pilot flame may be desirable.

SUMMARY

The present disclosure relates generally to water heaters, and more particularly to an ignition control of a water heater pilot flame. In an example embodiment, a method of controlling water heater pilot flame ignition includes receiving, by a controller of a water heater, a user input and controlling a pilot gas valve to start a gas flow to a pilot burner in response to the user input. The method further includes, in response to the user input, controlling, by the controller, an igniter to generate an ignition spark for lighting a pilot flame. The method also includes controlling, by the controller, the pilot gas valve to maintain the gas flow to the pilot burner if the pilot flame is lit.

In another example embodiment, a method of controlling water heater pilot flame ignition includes receiving, by a controller of a water heater, a user input and controlling a pilot gas valve to start a gas flow to a pilot burner. The method further includes controlling, by the controller, an igniter to generate an ignition spark for lighting a pilot flame in response to the user input. The method also includes controlling the igniter to stop generating the ignition spark if the pilot flame is lit.

In yet another example embodiment, a water heating system of a water heater includes a pilot burner, a pilot gas valve, an igniter, and a controller configured to control the pilot gas valve to start a gas flow to the pilot burner. The controller is further configured to control the igniter to provide an ignition spark to light a pilot flame in response to a user input and to control the pilot gas valve to maintain the gas flow to the pilot burner if the pilot flame is lit. The controller is also configured to provide a notification via a user interface of the water heater indicating whether the pilot flame is lit.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
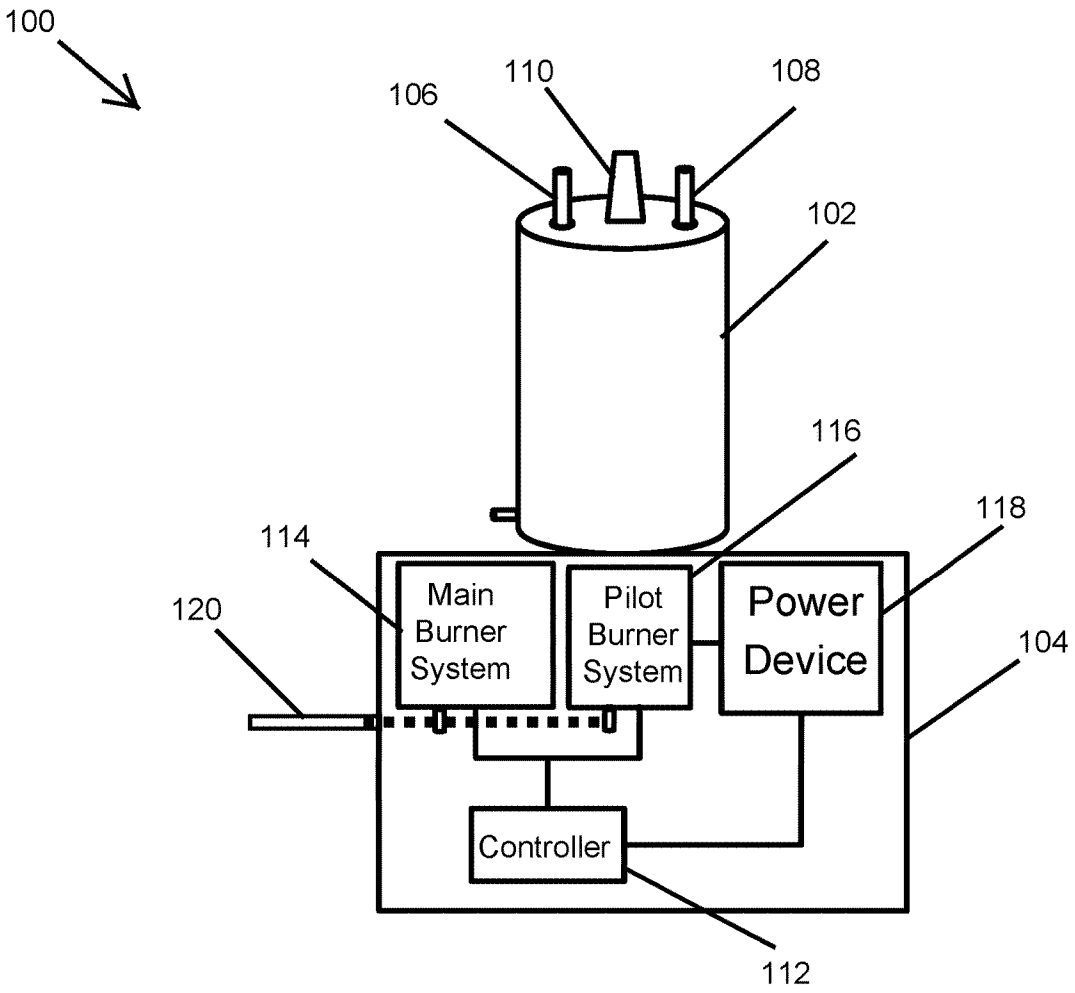
FIG. 1 illustrates a water heater including a water heating system according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding but not necessarily identical elements.

DETAILED DESCRIPTION OF THE EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates a water heater 100 including a water heating system 104 according to an example embodiment. For example, the water heater 100 may be a gas-fired water heater. In some example embodiments, the water heater 100 includes a water tank 102 and the water heating system 104, which is represented by a block diagram in FIG. 1. The water heating system 104 may provide gas-generated heat to heat water contained in the water tank 102. For example, a main burner of the water heater 100 may be located at the bottom of the water tank 102 and may provide a flame that heats the water in the water tank 102 as can be readily understood by those of ordinary skill in the art with the benefit of this disclosure.

In some example embodiments, an inlet pipe 106 that is fluidly connected to the cavity of the water tank 102 may direct cold water into the water tank 102, and an outlet pipe 108 that is fluidly connected to the cavity of the water tank 102 may direct heated water out of the water tank 102. The water heater 100 may also include an exhaust hood 110 for directing exhaust gas exiting the water heater 100.

In some example embodiments, the water heating system 104 may include a controller 112 that controls the operation of the water heating system 104. The controller 112 may include one or more microcontrollers and/or microprocessors that execute software code stored in one or more non-transitory memory devices (e.g., an SRAM) to perform the various functions including controlling the generation of the heat by water heating system 104 to heat water that may be in the water tank 102. For example, the controller 112 may include or may be communicably coupled to a non-volatile memory device containing executable software code.

In some example embodiments, the water heating system 104 may include a main burner system 114 and a pilot burner system 116. For example, the pilot burner system 116 may provide a pilot flame for lighting the main burner flame that is generated by the main burner system 114 to heat the water that is in the water tank 102. To illustrate, a gas supply pipe 120 may be used to provide fuel gas to the main burner system 114 and to the pilot burner system 116, and both the main burner system 114 and the pilot burner system 116 may use some of the supplied fuel gas to provide a respective flame.

In some example embodiments, the controller 112 may control the pilot burner system 116 to generate a pilot flame that is used to light a main burner flame provided by the main burner system 114. For example, the controller 112 may control the generation of the pilot flame by controlling the generation of an ignition spark and the availability of fuel gas to a pilot burner of the pilot burner system 116. To illustrate, the controller 112 may receive a user input to provide a pilot flame and control the generation of the pilot flame. For example, the controller 112 may receive the user input via a physically integrated user input interface (e.g., a button, a touch screen, etc.) of the water heating system 104. Alternatively or in addition, the controller 112 may receive the user input wirelessly or via a wired connection.

In response to the user input, the controller 112 may control a pilot gas valve of the pilot burner system 116 to start a gas flow to the pilot burner of the pilot burner system 116. For example, the controller 112 may provide a control signal to the pilot gas valve to open the pilot gas valve, which makes a fuel gas in the gas supply pipe 120 available to the pilot burner of the pilot burner system 116.

In some example embodiments, in response to the user input, the controller 112 may control an igniter of the pilot burner system 116 to provide an ignition spark for lighting the pilot flame by igniting the fuel gas provided to the pilot burner of the pilot burner system 116. For example, the controller 112 may start controlling the igniter to provide the ignition spark before, at the same time, or after the fuel gas becomes available to the pilot burner. The controller 112 may control the igniter to provide the ignition spark for a threshold time (e.g., 30 seconds, 60 seconds, 90 seconds, 120 seconds, etc.) regardless of whether the pilot flame is lit. For example, the controller 112 may control the igniter to stop generating the ignition spark after the ignition spark is provided for the threshold time. Alternatively, the controller 112 may control the igniter to provide the ignition spark until the pilot flame is lit if the pilot flame is lit by the ignition spark within the threshold time. For example, the controller 112 may receive a flame current from a flame sensor that indicates whether the pilot flame is lit, and the controller 112 may control the igniter to stop generating the ignition spark if the pilot flame is lit. If the pilot flame is not lit within the threshold time, the controller 112 may control the igniter to stop generating the ignition spark.

In some example embodiments, the controller 112 may control the pilot gas valve to stop the gas flow to the pilot burner if the pilot flame is not lit within a threshold time (e.g., 30 seconds, 60 seconds, 90 seconds, 120 seconds, etc.). For example, the controller 112 may determine whether the pilot flame is lit based on the flame current from the flame sensor.

In some example embodiments, the controller 112 may maintain the gas flow to the pilot burner after the pilot flame is lit such that the pilot burner system 116 provides a standing pilot flame for lighting the main burner flame whenever the main burner system 114 needs to heat the water in the water tank 102. To illustrate, after the pilot flame is lit by the ignition spark, the controller 112 may control the igniter to stop the ignition spark while the pilot gas valve remains open such that fuel gas continues to be provided to the pilot burner. For example, the controller 112 may control the pilot gas valve to maintain the gas flow to the pilot burner by providing a control signal to the pilot gas valve to keep the pilot gas valve open.

In some example embodiments, the controller 112 may provide a notification indicating whether the pilot flame is lit. For example, if the pilot flame is not lit by the ignition spark within the threshold time, the controller 112 may provide a notification indicating that the pilot flame is not lit. Alternatively or in addition, the controller 112 may provide a notification indicating that the pilot flame is lit if the pilot flame becomes lit by the ignition spark. If the controller 112 provides a notification indicating that the pilot flame is not lit at the end of the threshold time, a consumer may choose to provide another input to the water heating system 104 to provide the pilot flame. The water heating system 104 may repeat the operations described above to provide a pilot flame in response to the user input.

In some example embodiments, the controller 112 may provide a notification if the pilot flame is out after having been lit. For example, the controller 112 may receive a flame current from a flame sensor that indicates whether the pilot flame is lit, and the controller 112 may provide a notification indicating whether the pilot flame is lit. For example, the notification provided by the controller 112 to indicate that the pilot flame is out after having been lit may be the same or different from the notification provided by the controller 112 to indicate whether the pilot flame has become lit by the ignition spark.

In some example embodiments, the controller 112 may receive an input from a thermostat of the water heater 100 to heat the water in the water tank 102. In response to the input from the thermostat, the controller 112 may make fuel gas available to the main burner of the main burner system 114, and the pilot flame provided by the pilot burner system 116 may ignite the fuel gas provided to the main burner system 114. The flame produced by the main burner system 114 produces the heat for heating the water. Because the pilot flame provided by the pilot burner system 116 is continuously available to light the main burner flame, the controller 112 can control the main burner system 114 to quickly start heating the water in the water tank 102 without waiting for the pilot flame to be lit first in order to light the main burner flame.

In some example embodiments, the water heating system 104 may include a power device 118 that provides electrical power to at least some of the components of the water heating system 104. For example, the power device 118 may receive mains electricity (e.g., 120V AC) and generate power that is compatible with the components of the water heating system 104. For example, the power device 118 may include an AC/DC converter, DC/DC converter, etc. that may provide a direct-current power to one or more of the components of the water heating system 104.

In some example embodiments, the power device 118 may include a solar power system that provides an electrical power to one or more components of the water heating system 104. For example, the power device 118 may include typical solar power system components such as an inverter, a battery, etc. that can generate electrical power that is compatible with the components of the water heating system 104.

In some example embodiments, the power device 118 may include one or more power harvesting devices, such as one or more thermopiles, thermocouples, etc., that can provide adequate power for some or all of the electrically powered components of the water heating system 104 including the controller 112. For example, one or more power harvesting devices may generate electrical power from the heat produced by the pilot flame.

By providing a standing (i.e., continuous) pilot flame, a flammable vapor sensor or another device that detects or prevents the accumulation of a flammable vapor may be avoided, which can result in avoiding the high expense associated with such devices. By generating the pilot flame in response to a simple user input locally or remotely, the typical process of providing a pilot flame may be simplified for a typical consumer. By receiving a user input wirelessly or via a wired connection, the water heater 100 allows a consumer to remotely operate the water heater 100 to generate the pilot flame. Because of the notifications provided to a consumer or a technician indicating that the pilot flame is not lit by an ignition spark during an ignition cycle or that the pilot flame has gone out, a consumer/technician has the opportunity to provide an input to the water heater 100 to attempt to light/relight the pilot flame.

In some example embodiments, the water tank 102 may also include other components, such as a drain valve, one or more anodes, etc. In some alternative embodiments, the water heater 100 including the water tank 102 may have a different than shown without departing from the scope of this disclosure. In some alternative embodiments, the inlet and outlet pipes and other components may be at different locations than shown without departing from the scope of this disclosure. In some alternative embodiments, the water heater 100 may be a down-fired water heater, where at least some of the components of the water heating system 104, including the main burner and the pilot burner, are located at or proximal to the top end of the water tank 102. For example, in some example embodiments, the exhaust hood 110 may be omitted.

Figure 2:
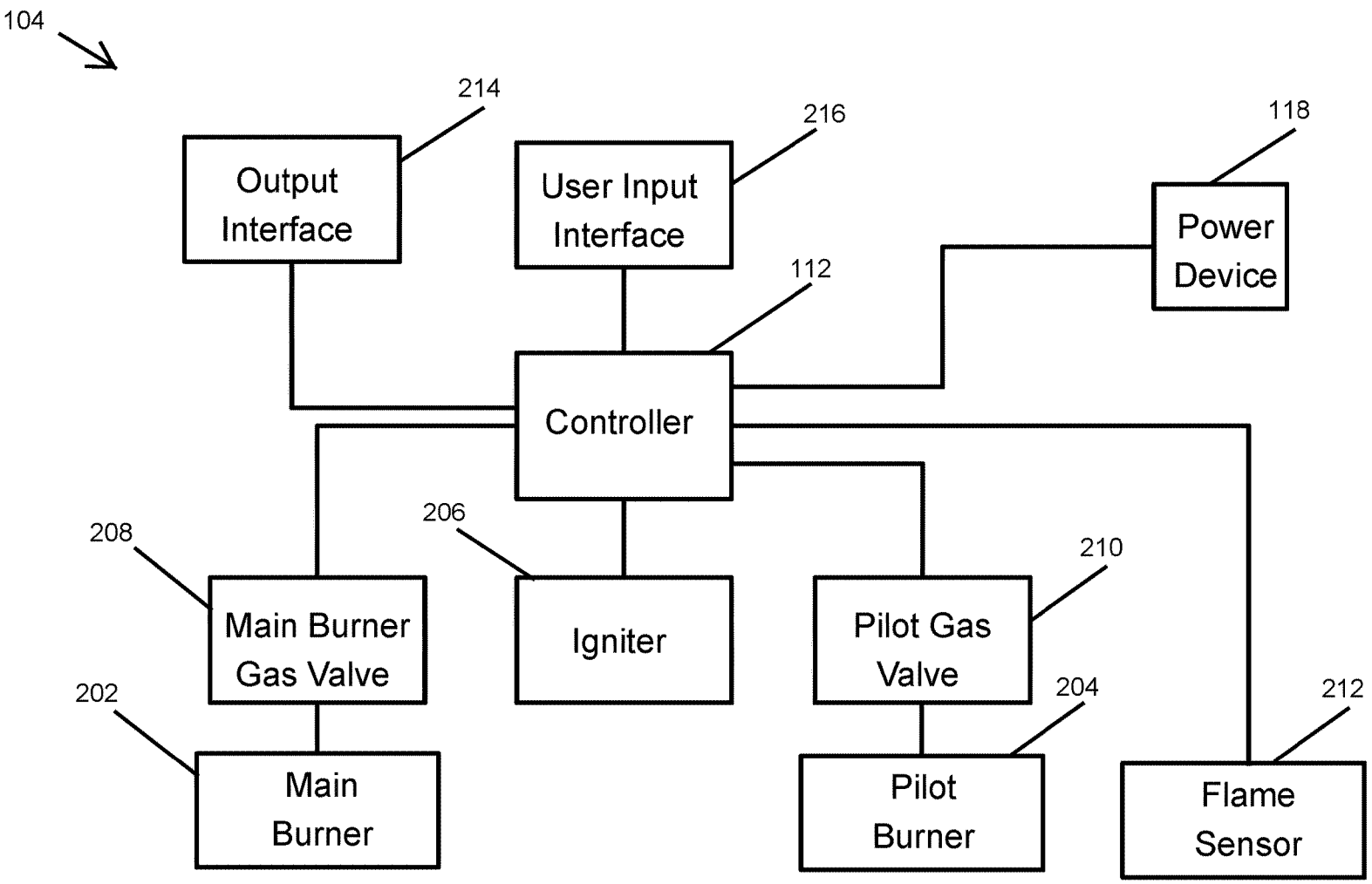
FIG. 2 illustrates the water heating system of FIG. 1 according to another example embodiment.

FIG. 2 illustrates the water heating system 104 of FIG. 1 according to another example embodiment. Referring to FIGS. 1 and 2, in some example embodiments, the water heating system 104 may include the controller 112, a main burner 202, a pilot burner 204, an igniter 206, and a flame sensor 212 (e.g., a flame sense rod). The water heating system 104 may also include a main burner gas valve 208 that is used to control the flow of fuel gas to the main burner 202. The water heating system 104 may also include a pilot gas valve 210 that is used to control the flow of fuel gas to the pilot burner 204. For example, the main burner 202 and the main burner gas valve 208 may be included in the main burner system 114 shown in FIG. 1, and the pilot burner 204, the igniter 206, the pilot gas valve 210, and the flame sensor 212 may be included in the pilot burner system 116 shown in FIG. 1.

In some example embodiments, the water heating system 104 may also include an output interface 214 and a user input interface 216. The output interface 214 may be used to provide notifications. For example, the output interface 214 may be used to provide visual and/or audio notifications. Alternatively or in addition, the output interface 214 may transmit notification messages wirelessly (e.g., Wi-Fi signals, Bluetooth signals, etc.) and/or via a wired connection (e.g., an Ethernet cable). To illustrate, the output interface 214 may include one or more of a display screen, a light source (e.g., one or more light emitting diodes), a speaker, a buzzer, or a transmitter.

In some example embodiments, the controller 112 may receive user inputs via the user input interface 216. For example, the user input interface 216 may include an integrated mechanical interface, such as a button or a knob, or another type of physical interface, such as a touch-sensitive screen. Alternatively or in addition, the user input interface 216 may include a receiver that can receive user inputs wirelessly (e.g., Wi-Fi signals, Bluetooth signals, etc.) and/or via a wired connection (e.g., an Ethernet cable). In some example embodiments, the output interface 214 and the user input interface 216 may be integrated into a single interface.

In some example embodiments, the water heating system 104 includes the power device 118. The power device 118 may provide power to the controller 112 via an electrical connection, such as one or more electrical wires and/or traces. In some example embodiments, the controller 112 may provide a control signal to the power device 118 to control some operations of the power device 118.

In some example embodiments, the pilot burner 204 may provide the pilot flame that is used to light the main burner flame from the main burner 202. To illustrate, the controller 112 may receive a user input via the user input interface 216 and, in response to the user input, the controller 112 may control the igniter 206 and the pilot gas valve 210 to generate a pilot flame that is used to light the main burner flame. For example, the controller 112 may receive the user input via a push button, a touch-sensitive screen, or wirelessly. In response to the user input, the controller 112 may provide a control signal to the pilot gas valve 210 (e.g., a solenoid valve) to start a flow of fuel gas to the pilot burner 204. Before, simultaneously, or after controlling the pilot gas valve 210 to make fuel gas available to the pilot burner 204, the controller 112 may provide, in response to the user input, a control signal to the igniter 206 to start the generation of an ignition spark by the igniter 206. For example, the igniter 206 may include an amplifier circuit or component that can generate the ignition spark from an input voltage (e.g., from the power device 118) provided to the igniter 206 as can be readily understood by those of ordinary skill in the art with the benefit of this disclosure. The ignition spark provided by the igniter may light the pilot flame by igniting the fuel gas provided to the pilot burner 204.

In some example embodiments, the controller 112 may control the igniter 206 to provide the ignition spark for a threshold time. For example, the controller 112 may control the igniter 206 to provide the ignition spark for 30 seconds, 60 seconds, 90 seconds, 120 seconds, or another time period. The controller 112 may provide a control signal to the igniter 206 for the threshold time via an electrical connection (e.g., an electrical wire or trace). To illustrate, the igniter 206 may generate the ignition spark as long as the igniter 206 receives the control signal from the controller 112. For example, the control signal provided to the igniter 206 may be a periodic signal, where the ignition spark is generated for the threshold time at the frequency of the control signal. The igniter 206 stops generating the ignition spark when the controller 112 stops sending the control signal to the igniter 206.

In some example embodiments, the controller 112 may send the control signal to the igniter 206 to generate the ignition spark for less than the threshold time if the controller 112 determines that the pilot flame has become lit before the threshold time has elapsed. For example, the controller 112 may determine from a flame current provided by the flame sensor 212 whether the pilot flame is lit by the ignition spark. If the controller 112 determines that the pilot flame is lit before the threshold time has elapsed, the controller 112 may stop sending the control signal to the igniter 206, and, in response, the igniter 206 may stop generating the ignition spark. Alternatively, the controller 112 may send another control signal to the igniter 206 to stop generating ignition spark, and the igniter 206 may stop generating the ignition spark in response to the control signal.

In some example embodiments, the controller 112 may control the pilot gas valve 210 to stop the gas flow to the pilot burner 204 if the pilot flame is not lit within a threshold time (e.g., 30 seconds, 60 seconds, 90 seconds, 120 seconds, etc.). For example, the controller 112 may determine whether the pilot flame is lit based on the flame current or other signal/information from the flame sensor 212. To illustrate, the controller 112 may send a control signal to the pilot gas valve 210 to close the pilot gas valve 210 or otherwise stop the flow of the fuel gas to the pilot burner 204 in response to determining that the pilot flame is not lit by the end of the threshold time. The controller 112 may stop the generation of the ignition spark and the availability of fuel gas to the pilot burner 204 based on the same threshold time or different threshold times.

In some example embodiments, the controller 112 may maintain the gas flow to the pilot burner 204 after the pilot flame is lit such that the pilot burner 204 continues to provide the pilot flame after the threshold time. To illustrate, after the pilot flame is lit by the ignition spark, the controller 112 may control the igniter 206 to stop the ignition spark and control the pilot gas valve 210 to maintain the flow of fuel gas to the pilot burner 204, which results in the pilot burner 204 providing a standing (i.e., continuous) pilot flame for lighting the main burner flame. For example, the controller 112 may continue to send a control signal to the pilot gas valve 210 to keep the pilot gas valve 210 open such that the fuel gas continues to flow to the pilot burner 204.

In some example embodiments, the controller 112 may provide a notification indicating whether the pilot flame is lit. For example, if the pilot flame is not lit by the ignition spark within the threshold time, the controller 112 may provide a notification via the output interface 214 indicating that the pilot flame is not lit. For example, the controller 112 may send a signal to the output interface to provide a visual notification and/or an audio notification indicating whether the pilot flame is lit at the end of the threshold time or that the pilot flame is not lit at the end of the threshold time. For example, the output interface 214 may emit a light (e.g., a particular color light) by a light source of the output interface 214 or display a message on a display screen of the water heating system 104. Alternatively or in addition, the output interface 214 may generate a sound (e.g., a buzzer sound). Alternatively or in addition to visual and/or audio notification, the controller 112 may send a signal to the output interface 214 to transmit a notification message indicating whether the pilot flame is lit at the end of the threshold time or that the pilot flame is not lit at the end of the threshold time, and the output interface 214 may transmit the notification message wirelessly or via a wired connection. In response to the notification, a consumer may choose to provide another input to the water heating system 104 to start the pilot flame. In response to the user input, the water heating system 104 may repeat the operations described above to generate the pilot flame.

In some example embodiments, the controller 112 may provide a notification if the pilot flame goes out after having been lit. For example, the controller 112 may receive a flame current from the flame sensor 212 that indicates whether the pilot flame is lit, and the controller 112 may provide a notification signal to the output interface 214 to provide a notification (e.g., visual, audio, and or transmitted message) indicating that the pilot flame is not lit in a similar manner as described above. In response to the notification, a consumer may choose to provide an input to the water heating system 104 to start the pilot flame. In response to the user input, the water heating system 104 may repeat the operations described above to generate the pilot flame.

In some example embodiments, the controller 112 may receive an input from a thermostat of the water heater 100 to heat the water in the water tank 102. In response to the input from the thermostat, the controller 112 may control the main burner gas valve 208 (e.g., a solenoid valve) to provide fuel gas to the main burner 202. For example, the controller 112 may send a control signal to the main burner gas valve 208 to open the main burner gas valve 208 or otherwise make the fuel gas available to the main burner 202. Because the pilot flame is continuously provided by the pilot burner 204, the pilot flame may ignite the fuel gas provided to the main burner 202 to light the main burner flame. In response to an input from thermostat to stop providing heat, the controller 112 may control the main burner gas valve 208 to stop the gas flow to the main burner 202. For example, the controller 112 may stop sending the control signal to the main burner gas valve 208 or send another control signal to close the main burner gas valve 208 or to otherwise stop the flow of the fuel gas to the main burner 202.

In some alternative embodiments, the water heating system 104 may include components other than shown in FIG. 2 without departing from the scope of this disclosure. In some alternative embodiments, some of the components of the water heating system 104 may be integrated into a single component without departing from the scope of this disclosure. In some example embodiments, the power device 118 may provide power to other components of the water heating system 104 including the igniter 206, the output interface 214, and the user input interface 216 without departing from the scope of this disclosure.

Figure 3:
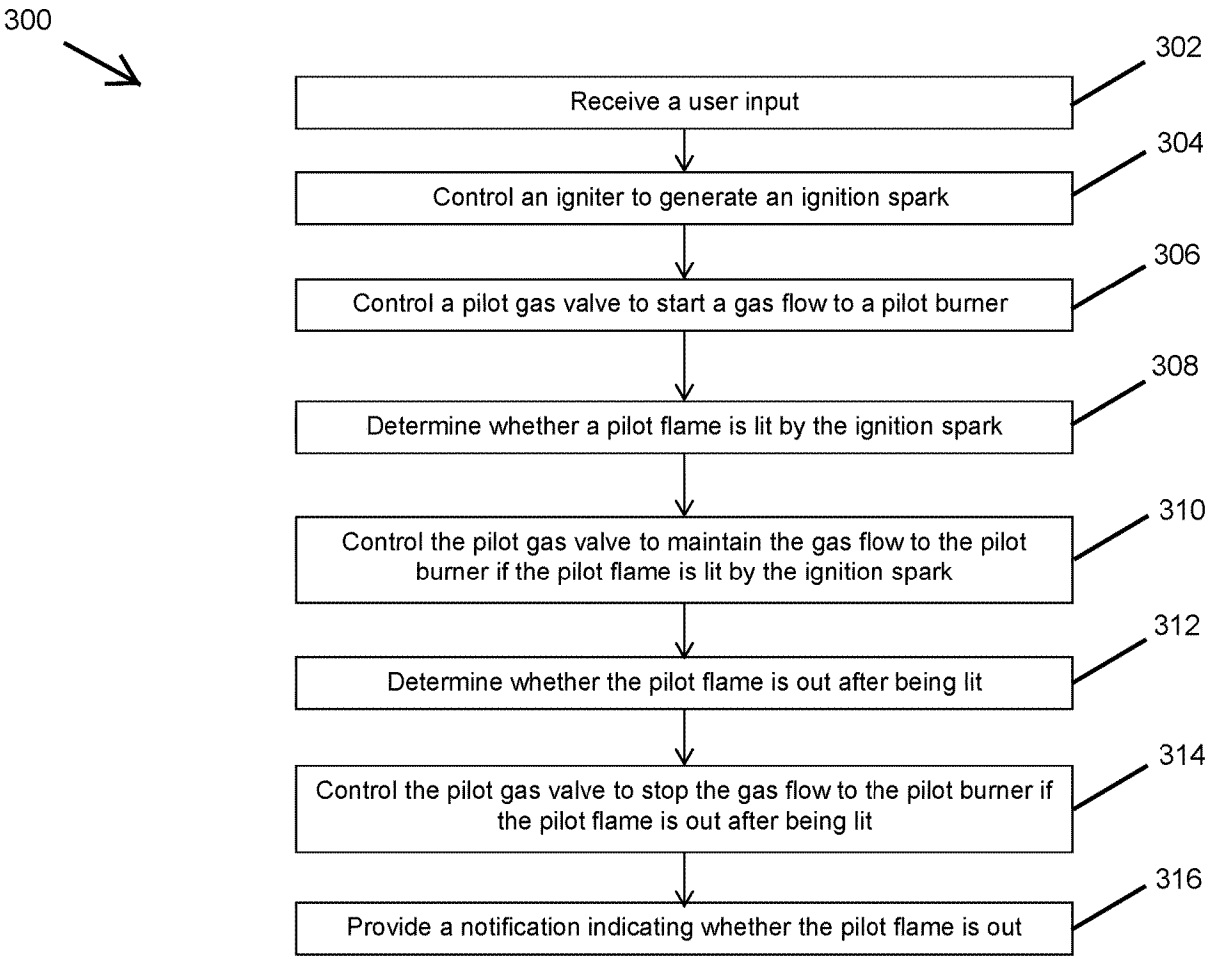
FIG. 3 illustrates a method of controlling a pilot flame ignition according to an example embodiment.

FIG. 3 illustrates a method 300 of controlling a pilot flame ignition according to an example embodiment. Referring to FIGS. 1-4, in some example embodiments, at step 302, the method 300 may include receiving, by the controller 112 of the water heater 100, a user input. For example, the controller 112 may receive user input wirelessly or mechanically via the user input interface to start the pilot flame. At step 304, the method 300 may include, in response to the user input, controlling, by the controller 112, the pilot gas valve 210 to start a gas flow to the pilot burner 212. For example, the controller 112 may send a control signal to the pilot gas valve 210 to open the pilot gas valve 210 allowing fuel gas to flow to the pilot burner 204.

At step 306, the method 300 may include, in response to the user input, controlling, by the controller 112, the igniter 206 to generate an ignition spark for lighting the pilot flame. For example, the controller 112 may send a control signal to the igniter 206 to generate the ignition spark. The controller 112 may control the igniter 206 to generate the ignition spark before, after, or at the same time that the controller 112 controls the pilot gas valve 210 to start the gas flow to the pilot burner 212.

At step 308, the method 300 may include determining, by the controller 112, whether the pilot flame is lit by the ignition spark. For example, the controller 112 may determine whether the pilot flame is lit based on a flame current received from the flame sensor 212, where the amount of current may correspond to the amount of heat detected by the flame sensor 212. For example, the flame sensor 212 may be located close to the pilot burner 204 to sense the heat generated by the pilot flame. If the pilot flame is not lit, the amplitude of the flame current received by the controller 112 from the flame sensor 212 may be zero or close to zero. In some alternative embodiments, the controller 112 may determine whether the pilot flame is lit based on other information from the flame sensor 212 instead of the flame current. The method 300 may also include providing, by the controller 112, a notification indicating whether the pilot flame is lit by the ignition spark. The controller 112 may provide one or more of the different types of notification (e.g., visual, audio, transmitted message, etc.), for example, to a consumer or a contractor. For example, the controller 112 may transmit a notification message indicating whether the pilot flame is lit by the ignition spark to a mobile device that operates an applicable software application.

At step 310, the method 300 may include controlling, by the controller 112, the pilot gas valve 210 to maintain the gas flow to the pilot burner 204 if the pilot flame is lit, for example, as determined in step 308. For example, to maintain the gas flow to the pilot burner 204, the controller 112 may keep providing to the pilot gas valve 210 the control signal that the controller 112 provided to the pilot gas valve 210 to start the gas flow.

At step 312, the method 300 may include determining, by the controller 112, whether the pilot flame is out after being lit. For example, after the pilot flame is lit by the ignition spark as described above, the pilot flame may go out for a number of reasons including a breeze, a gas flow disruption, etc. For example, the controller 112 may determine whether the pilot flame is out based on the flame current or another information from the flame sensor 212 that senses the pilot flame as described above. If the controller 112 determines that the pilot flame is out, at step 314, the method 300 may include controlling, by the controller 112, the pilot gas valve 210 to stop the gas flow to the pilot burner 204. At step 316, the method 300 may include providing, by the controller 112, a notification indicating whether the pilot flame is out if the controller 112 determines that the pilot flame has gone out after having been lit. For example, the controller 112 determine that the pilot flame lit and when the pilot flame has gone out based on the flame current 212 and provide a visual, audio, and/or a transmitted message notification in a similar manner as described above to indicate that the pilot flame is not lit or has gone out.

In some example embodiments, one or more steps of the method 300 may be omitted without departing from the scope of this disclosure. In some example embodiments, the method 300 may include additional steps than described above without departing from the scope of this disclosure. In some example embodiments, some of the steps of the method 300 may be performed in a different order than described above without departing from the scope of this disclosure.

Figure 4:
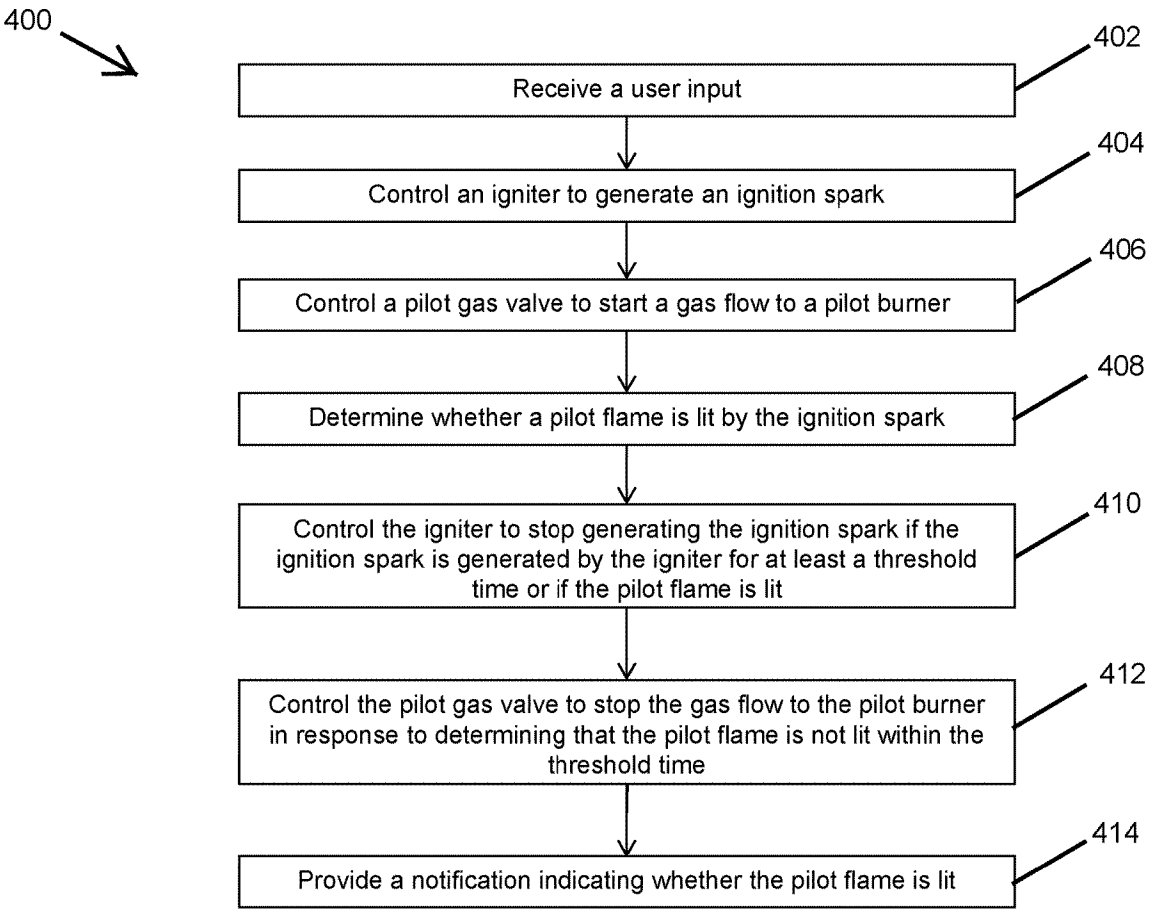
FIG. 4 illustrates a method of controlling a pilot flame ignition according to another example embodiment.

FIG. 4 illustrates a method 400 of controlling a pilot flame ignition according to another example embodiment. Referring to FIGS. 1, 2 and 4, in some example embodiments, at step 402, the method 400 may include receiving, by the controller 112 of the water heater 100, a user input. For example, the controller 112 may receive user input wirelessly or mechanically via the user input interface to start the pilot flame. At step 404, the method 400 may include, in response to the user input, controlling, by the controller 112, the pilot gas valve 210 to start a gas flow to the pilot burner 212. For example, the controller 112 may send a control signal to the pilot gas valve 210 to open the pilot gas valve 210 allowing fuel gas to flow to the pilot burner 204.

At step 406, the method 400 may include, in response to the user input, controlling, by the controller 112, the igniter 206 to generate an ignition spark for lighting the pilot flame. For example, the controller 112 may send a control signal to the igniter 206 to generate the ignition spark. The controller 112 may control the igniter 206 to generate the ignition spark before, after, or at the same time that the controller 112 controls the pilot gas valve 210 to start the gas flow to the pilot burner 212.

At step 408, the method 400 may include determining, by the controller 112, whether the pilot flame is lit by the ignition spark. For example, the controller 112 may determine whether the pilot flame is lit based on a flame current received from the flame sensor 212 as described above. At step 410, the method 400 may include controlling, by the controller 112, the igniter 206 to stop generating the ignition spark if the ignition spark is generated by the igniter 206 for at least a threshold time (e.g., 90 seconds) or if the pilot flame becomes lit by the ignition spark. For example, if the pilot flame is not lit by the ignition spark after the igniter 206 has been generating the ignition spark for the threshold time, the controller 112 may control the igniter 206 to stop the generation of the ignition spark. For example, the controller 112 may stop sending to the igniter 206 the control signal that cause the igniter 206 to generate the ignition spark. If the pilot flame is lit before the threshold time has elapsed, the controller 112 may control the igniter 206 to stop the generation of the ignition spark prior to the end of the threshold time.

If the controller 112 determines that the pilot flame is not lit within the threshold time from the start of the generation of the ignition spark, at step 412, the method 400 may include controlling, by the controller 112, the pilot gas valve 210 to stop the gas flow to the pilot burner 204. For example, the controller 112 may control the pilot gas valve 210 to close the pilot gas valve 210 or otherwise stop the flow of fuel gas to the pilot burner 204. At step 414, the method 400 may include providing, by the controller 112, a notification indicating whether the pilot flame is lit. For example, the controller 112 may determine that the pilot flame has not been lit within the threshold time and provide a visual, audio, and/or a transmitted message notification in a similar manner as described above to indicate that the pilot flame has not been lit within the threshold time. The controller 112 may also provide a notification when the pilot flame goes out after having been lit in a similar manner as described above including with respect to the method 300.

In some example embodiments, one or more steps of the method 400 may be omitted without departing from the scope of this disclosure. In some example embodiments, the method 400 may include additional steps than described above without departing from the scope of this disclosure. For example, the method 400 may include some the steps of the method 300 without departing from the scope of this disclosure. In some example embodiments, some of the steps of the method 400 may be performed in a different order than described above without departing from the scope of this disclosure.

Figure 5:
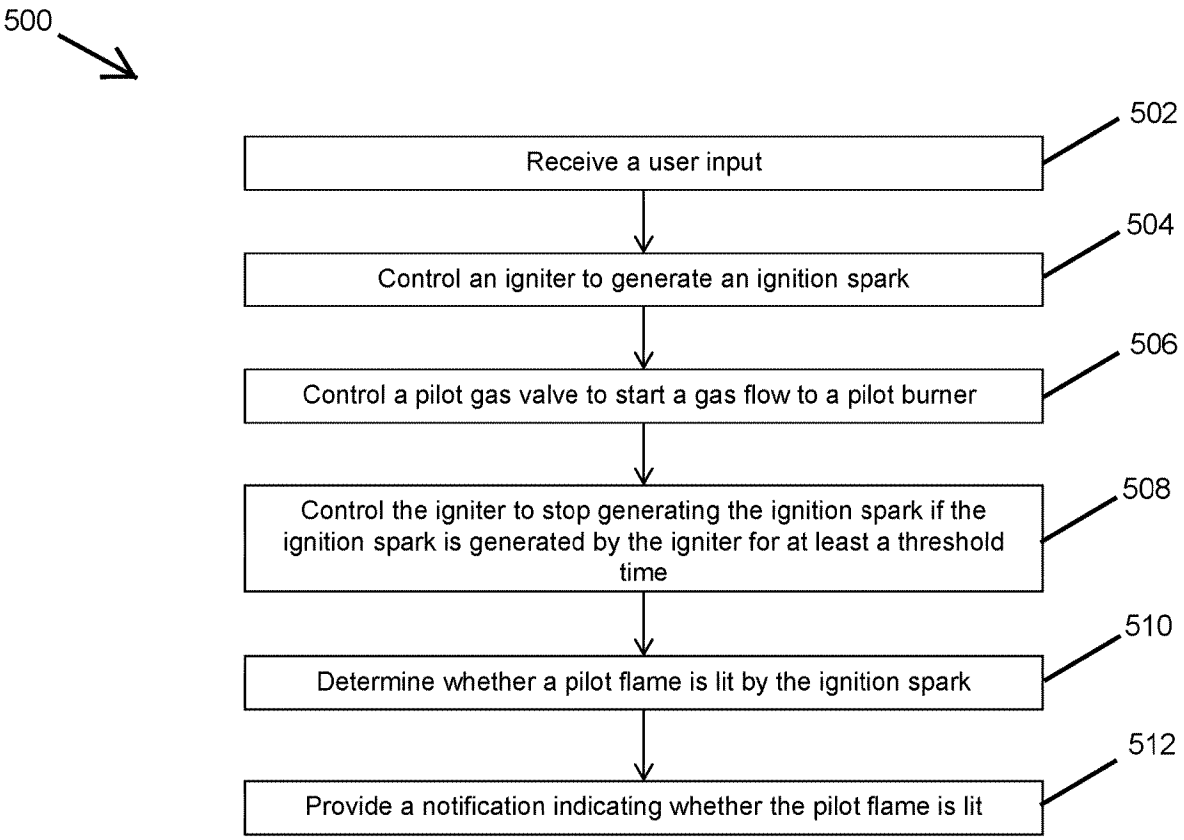
FIG. 5 illustrates a method of controlling a pilot flame ignition according to another example embodiment.

FIG. 5 illustrates a method 500 of controlling a pilot flame ignition according to another example embodiment. Referring to FIGS. 1, 2 and 5, in some example embodiments, at step 502, the method 500 may include receiving, by the controller 112 of the water heater 100, a user input. For example, the controller 112 may receive user input wirelessly or mechanically via the user input interface to start the pilot flame. At step 504, the method 500 may include, in response to the user input, controlling, by the controller 112, the pilot gas valve 210 to start a gas flow to the pilot burner 212. For example, the controller 112 may send a control signal to the pilot gas valve 210 to open the pilot gas valve 210 allowing fuel gas to flow to the pilot burner 204.

At step 506, the method 500 may include, in response to the user input, controlling, by the controller 112, the igniter 206 to generate an ignition spark for lighting the pilot flame. For example, the controller 112 may send a control signal to the igniter 206 to generate the ignition spark. The controller 112 may control the igniter 206 to generate the ignition spark before, after, or at the same time that the controller 112 controls the pilot gas valve 210 to start the gas flow to the pilot burner 212.

At step 508, the method 500 may include controlling, by the controller 112, the igniter 206 to stop generating the ignition spark if the ignition spark is generated by the igniter 206 for at least a threshold time (e.g., 90 seconds). For example, the controller 112 may control the igniter 206 to generate the ignition spark for the entire duration of the threshold time regardless of whether the pilot flame is already lit by the ignition spark. To illustrate, at the end of the threshold time, the controller 112 may control the igniter 206 to stop generating the ignition spark. For example, the controller 112 may stop sending to the igniter 206 the control signal that cause the igniter 206 to generate the ignition spark. If the pilot flame is lit before the threshold time has elapsed, the controller 112 may control the igniter 206 to stop the generation of the ignition spark prior to the end of the threshold time.

At step 510, the method 500 may include determining, by the controller 112, whether the pilot flame is lit by the ignition spark. For example, the controller 112 may determine whether the pilot flame is lit based on a flame current received from the flame sensor 212 as described above.

At step 512, the method 500 may include providing, by the controller 112, a notification indicating whether the pilot flame is lit. For example, the controller 112 may determine that the pilot flame has not been lit during or at the end of the threshold time and provide a visual, audio, and/or a transmitted message notification in a similar manner as described above to indicate that the pilot flame has not been within the threshold time. The controller 112 may also provide a notification when the pilot flame goes out after having been lit in a similar manner as described above including with respect to the method 300. Alternatively, the controller 112 may provide a notification when the pilot flame is or becomes lit.

In some example embodiments, one or more steps of the method 500 may be omitted without departing from the scope of this disclosure. In some example embodiments, the method 500 may include additional steps than described above without departing from the scope of this disclosure. For example, the method 500 may include some the steps of the methods 300 and 400 without departing from the scope of this disclosure. In some example embodiments, some of the steps of the method 500 may be performed in a different order than described above without departing from the scope of this disclosure.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method of controlling water heater pilot flame ignition, the method comprising:

determining, by a controller of a water heater, that first data received from a flame sensor at a first time indicate that a continuous pilot flame at a pilot burner is not lit;

controlling, by the controller, an igniter to generate an ignition spark for a threshold time for lighting the continuous pilot flame at the pilot burner in response to a user input, the threshold time based on the determination that the first data received from the flame sensor indicate that the continuous pilot flame is not lit; and in response to determining that the continuous pilot flame remains unlit after expiration of the threshold time based on second data received from the flame sensor after the first time, outputting a control signal to control a pilot gas valve to stop a gas flow to the pilot burner.

2. The method of claim 1, further comprising:

in response to determining that the continuous pilot flame is not lit, outputting a first wireless notification for delivery to a mobile user device indicating that the continuous pilot flame is not lit; and in response to determining that the continuous pilot flame remains unlit after expiration of the threshold time, outputting a second wireless notification for delivery to the mobile user device indicating that the continuous pilot flame remains unlit, wherein the first wireless notification and the second wireless notification include a visual notification or an audio notification.

3. The method of claim 1, wherein an indication of the user input is received wirelessly by a user input interface.

4. The method of claim 1, wherein the threshold time is associated with a vapor based on the continuous pilot flame.

5. The method of claim 1, wherein the gas flow to the pilot burner is continuous after determining that the continuous pilot flame is not lit until expiration of the threshold time.

6. A method of controlling water heater pilot flame ignition, the method comprising:

determining, by a controller of a water heater, that first data received from a flame sensor at a first time indicate that a continuous pilot flame at a pilot burner is not lit;

controlling, by the controller, an igniter to generate an ignition spark for a threshold time for lighting the continuous pilot flame at the pilot burner in response to a user input, the threshold time based on the determination that the first data received from the flame sensor indicate that the continuous pilot flame is not lit;

controlling, by the controller, the igniter to stop generating the ignition spark based on a determination that the continuous pilot flame remains unlit after expiration of the threshold time based on second data received from the flame sensor after the first time; and controlling, by the controller, a pilot gas valve to stop a gas flow to the pilot burner based on the determination that the continuous pilot flame remains unlit after expiration of the threshold time based on the second data received from the flame sensor after the first time.

7. The method of claim 6, further comprising:

in response to determining that the continuous pilot flame is not lit, outputting a first wireless notification for delivery to a mobile user device indicating that the continuous pilot flame is not lit; and in response to determining that the continuous pilot flame remains unlit after expiration of the threshold time, outputting a second wireless notification for delivery to the mobile user device indicating that the continuous pilot flame remains unlit, wherein the first wireless notification includes a visual notification or an audio notification.

8. The method of claim 6, further comprising:

determining, by the controller, whether the continuous pilot flame is unlit after being lit; and outputting a third notification for delivery to a user device indicating whether the continuous pilot flame is unlit.

9. The method of claim 6, wherein an indication of the user input is received wirelessly via a user input interface of the water heater.

10. The method of claim 6, wherein the threshold time is associated with a vapor based on the continuous pilot flame.

11. The method of claim 6, wherein the gas flow to the pilot burner is continuous after determining that the continuous pilot flame is not lit until expiration of the threshold time.

12. A water heating system of a water heater, comprising:

a pilot burner;

a pilot gas valve;

an igniter;

a flame sensor; and a controller configured to:

determine that first data received from the flame sensor at a first time indicate that a continuous pilot flame at the pilot burner is not lit;

control the igniter to provide an ignition spark for a threshold time to light the continuous pilot flame at the pilot burner in response to a user input, the threshold time based on the determination that the first data received from the flame sensor indicate that the continuous pilot flame is not lit; and control the pilot gas valve to maintain a gas flow to the pilot burner if the continuous pilot flame is lit within the threshold time based on second data received from the flame sensor after the first time.

13. The water heating system of claim 12, wherein an electrical power is provided to the controller by a power device that generates the electrical power from mains power, a solar power, or a battery power.

14. The water heating system of claim 12, wherein the controller is further configured to, in response to determining that the continuous pilot flame remains unlit after expiration of the threshold time, outputting a control signal to control the pilot gas valve to stop the gas flow to the pilot burner.

15. The water heating system of claim 12, wherein the controller is further configured to control the igniter to stop generating the ignition spark upon the first of (1) determining the threshold time has expired and (2) determining, based on the second data received from the flame sensor, that the continuous pilot flame is lit.

16. The water heating system of claim 12, wherein the controller is further configured to:

in response to determining that the continuous pilot flame remains unlit after expiration of the threshold time based on the second data received from the flame sensor, control the pilot gas valve to stop the gas flow to the pilot burner; and in response to determining that the continuous pilot flame remains unlit after expiration of the threshold time based on the second data received from the flame sensor, outputting a third wireless notification for delivery to a user device indicating that the continuous pilot flame is unlit.

17. The water heating system of claim 12, wherein the threshold time is associated with a vapor based on the continuous pilot flame.

18. The water heating system of claim 12, wherein the gas flow to the pilot burner is continuous after determining that the continuous pilot flame is not lit until expiration of the threshold time.

* * * * *